US012338715B1

(12) United States Patent
Bandar et al.

(10) Patent No.: US 12,338,715 B1
(45) Date of Patent: Jun. 24, 2025

(54) CLEANING AND INSPECTING A WELLBORE

(71) Applicant: Saudi Arabian Oil Company, Dhahran (SA)

(72) Inventors: Malki Bandar, Dammam (SA); Humood Malik, Saihat (SA); Miguel Augusto Avila Romero, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/390,319

(22) Filed: Dec. 20, 2023

(51) Int. Cl.
*E21B 37/00* (2006.01)
*E21B 47/002* (2012.01)
*E21B 47/26* (2012.01)

(52) U.S. Cl.
CPC ..... *E21B 37/00* (2013.01); *E21B 47/002* (2020.05); *E21B 47/26* (2020.05)

(58) Field of Classification Search
CPC ..... E21B 37/00; E21B 47/002; E21B 21/00
See application file for complete search history.

(56) References Cited

U.S. PATENT DOCUMENTS 2,327,051 A * 8/1943 Lyons ..... E21B 37/00 166/333.1
5,123,492 A * 6/1992 Lizanec, Jr. ..... E21B 17/00 175/49
5,280,825 A * 1/1994 Cholet ..... E21B 37/00 166/311
6,883,605 B2 4/2005 Arceneaux et al.
7,028,769 B2 * 4/2006 Mullins ..... E21B 21/103 166/311
7,751,038 B2 * 7/2010 Vessereau ..... G02B 23/02 356/241.1
8,267,181 B2 * 9/2012 Peixoto ..... E21B 41/0078 166/373
8,453,724 B2 * 6/2013 Zhou ..... E21B 31/08 166/99
11,041,354 B2 6/2021 Pipchuk et al.
2016/0168939 A1 * 6/2016 Harris ..... E21B 27/005 166/250.01
2022/0298889 A1 9/2022 Falk et al.

OTHER PUBLICATIONS

Fang et al., "Analysis and application of cleaning tool structure in negative pressure reverse circulating wellbore," Advances in Mechanical Engineering, Jun. 2020, 12(8):1-15.

* cited by examiner

*Primary Examiner* — Kenneth L Thompson
(74) *Attorney, Agent, or Firm* — Fish & Richardson P.C.

(57) ABSTRACT

Systems and methods for cleaning and inspecting a wellbore. A wellbore cleaning tool has a jetting sub-assembly, a reverse circulation sub-assembly, and a guide shoe sub-assembly with a camera. The jetting sub-assembly has jetting nozzles oriented to direct a fluid at the wellbore. The reverse circulation sub-assembly has a barrel defining two inner voids fluidly decouplable from each other. The barrel has a first fluid port. A first set of outlet ports extend through the barrel from the one inner void to outside the wellbore cleaning tool. A second set of outlet ports extend through the barrel from the other inner void to outside the wellbore cleaning tool. The second fluid port controls fluid flow from outside the wellbore cleaning tool and the second inner void. A third fluid port controls fluid flow through the other inner void fluidly to the jetting sub-assembly.

15 Claims, 4 Drawing Sheets

CLEANING AND INSPECTING A WELLBORE

TECHNICAL FIELD

This disclosure relates to cleaning and inspecting a wellbore, for example, with a wellbore cleaning tool.

BACKGROUND

Hydrocarbons are trapped in reservoirs in subterranean formations of the Earth. Wellbores are drilled through subterranean formations to those reservoirs to raise the hydrocarbons to the surface of the Earth. The wellbore can accumulate a quantity of debris and junk from the subterranean formations or wellbore completion equipment. The accumulation of debris and junk in the wellbore can, in some cases, reduce wellbore production or damage completion equipment installed in the wellbore.

SUMMARY

This disclosure describes technologies related to cleaning and inspecting a wellbore. A wellbore cleaning tool can be run into the wellbore to clean an inner surface of the wellbore, remove junk and debris from the wellbore, and inspect the wellbore.

The wellbore cleaning tool of the present disclosure can be run in the wellbore. The wellbore cleaning tool has a reverse circulation sub-assembly, a jetting sub-assembly, and a guide shoe sub-assembly with a camera, a light source, and a controller.

Implementations of the present disclosure can realize one or more of the following advantages. For example, this approach can clean and inspect the wellbore by using the wellbore cleaning tool, avoiding the need to use three separate tools in three separate trips. By cleaning and inspecting the wellbore in a single run, a total time required to clean and inspect the wellbore can be reduced. In some cases, the total time required to clean and inspect the wellbore can be reduced by multiple days. Reducing the number of trips can also reduce the complexity of cleaning and inspecting operations and reduce associated risks to personnel.

This approach can also improve the cleanliness of the wellbore. For example, this approach can more quickly remove the debris and junk entrained in wellbore fluid, reducing the quantity of the debris and junk from settling in the wellbore by reducing static time between cleaning and removal operations which allows debris and junk to settle. In particular, this approach enables cleaning the wellbore with the jetting sub-assembly and immediately switching to cleaning and removing junk and debris with the reverse circulation sub-assembly without tripping conventional cleaning tools out of the wellbore and conventional removal tools back into the wellbore.

This approach can also increase completion equipment life. For example, by increasing the quantity of debris and junk removed from the wellbore containing completion equipment such as inflow control valves, hydraulic line wet mate connectors, seals, and packers and exposed to less debris and junk, wear and damage to the completion equipment can be reduced.

This approach can also reduce stuck pipe events. For example, in some cases, debris and junk can accumulate in the wellbore, reducing an effective inner diameter of the wellbore, causing pipes and production tubing to become stuck when passing through the reduced diameter portion. By cleaning and inspecting the wellbore with the wellbore cleaning tool, the accumulations of debris and junk can be reduced or even removed, increasing the effective inner diameter of the wellbore, reducing stuck pipe events.

This approach can also clean smart receptacles. Smart receptacles can include delicate instruments and components, and maintaining cleanliness of the smart receptacles is critical for proper operation. The wellbore cleaning tool can clean the smart receptacle without damaging the delicate components. Facing a stuck pipe event in the smart receptacle, damage can occur to the smart receptacle, resulting in loss of functionality of a costly smart receptacle and completion assembly.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes systems and methods for cleaning and inspecting a wellbore. Sometimes, debris and junk can accumulate in one or more locations within the wellbore. The debris and junk can damage completion equipment, clog ports, and build up on an inner surface of the wellbore, reducing flow through the wellbore or causing pipes passing through the wellbore to become stuck. These systems and methods can enable an efficient approach to cleaning and inspecting a wellbore to reduce the debris and junk in the wellbore.

In particular, cleaning and inspecting a wellbore in a single trip can reduce the total time required to clean and inspect the wellbore. Also, the cleanliness of the wellbore can be improved by reducing the static time between the end of cleaning operations and the start of removal operations.

Figure 1:
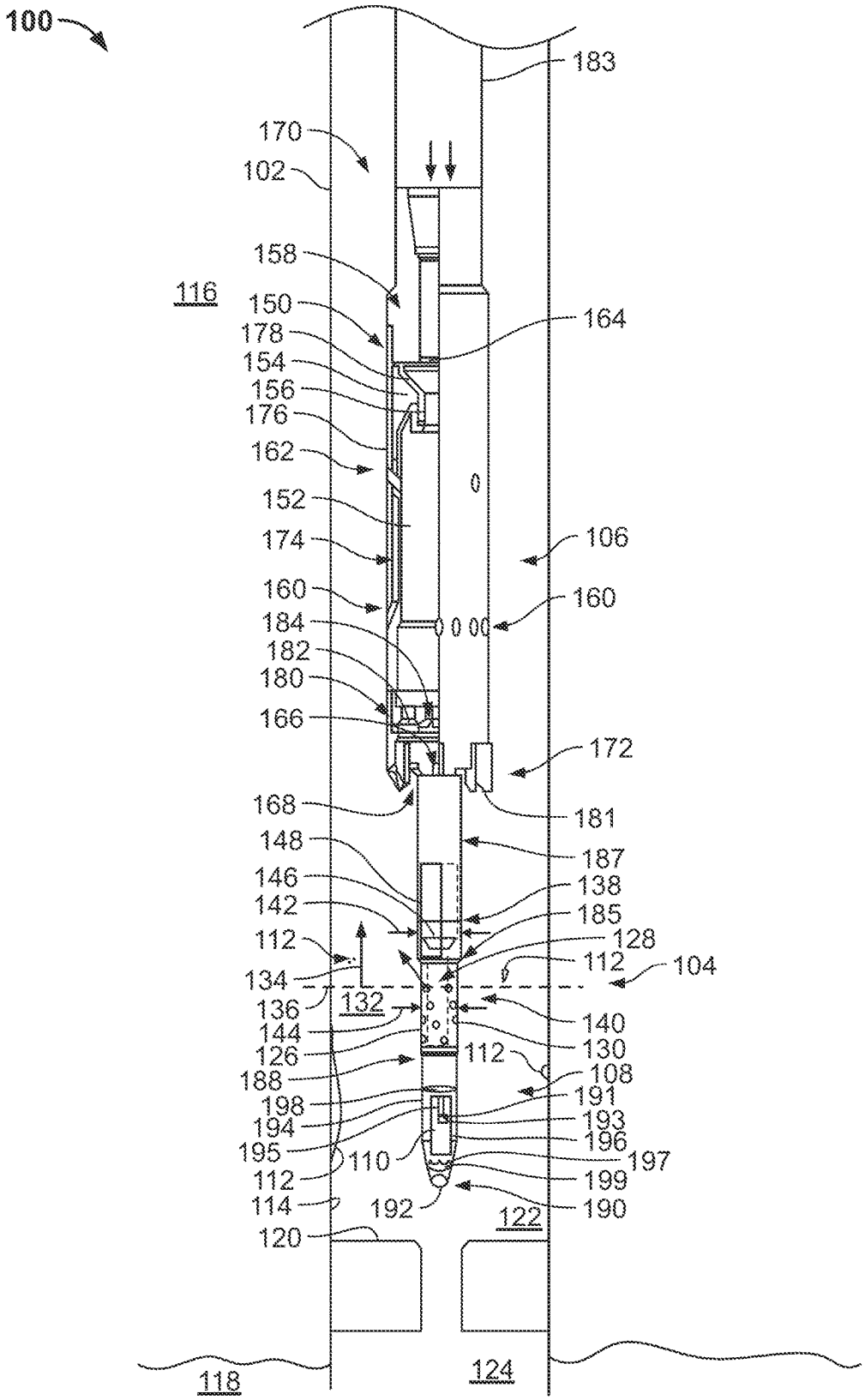
FIG. 1 is a schematic view of a wellbore cleaning tool cleaning a wellbore with a jetting sub-assembly.

FIG. 1 is a schematic view of a wellbore cleaning tool 100 cleaning a wellbore 102 with a jetting sub-assembly 104. The wellbore cleaning tool 100 includes the jetting sub-assembly 104, a reverse circulation sub-assembly 106, and a guide shoe sub-assembly 108 with a camera 110. The jetting sub-assembly 104 dispenses fluid from within the wellbore cleaning tool 100 into the wellbore 102 to remove junk and debris 112 from an inner surface 114 or other completion components (not shown). The reverse circulation sub-assembly 106 removes the junk and debris 112 from the wellbore 102. The guide shoe sub-assembly 108 guides the wellbore cleaning tool 100 through the wellbore 102 and protects the camera 110 so the camera 110 can inspect the inner surface 114 of the wellbore 102 or the completion components.

The wellbore 102 is drilled and cased from a surface the Earth through subterranean formations 116 to a hydrocarbon reservoir 118 containing fluids such as hydrocarbons, water, and other chemicals and particulates. The wellbore 102 conducts the fluids contained within the hydrocarbon reservoir to the surface for production and refinement. Sometimes, the fluids can cause junk and debris 112 in the form of solids or sludge buildup, or in some cases, corrosion accumulation on the inner surface 114 of the wellbore 102. In other cases, completion operations or normal production operations can result in junk and debris 112 produced from completion equipment such as metal shavings accumulating in the wellbore 102, for example, from milling operations or equipment wear and/or failure. Metal debris can be introduced during completion operations such as replacing the existing pre-installed completion accessories. The wellbore cleaning tool 100 can inspect the inner surface 114 for junk and debris 112, clean and remove some of the junk and debris 112, then re-inspect the inner surface 114 of the wellbore 102.

A receptacle 120 can be positioned in the wellbore 102. The receptacle 120 separates an uphole portion 122 of the wellbore 102 from a downhole portion 124 of the wellbore 102. The receptacle 120 is sized and shaped to receive and seal against the wellbore cleaning tool 100, but not allow the entire wellbore cleaning tool 100 to pass. For example, the receptacle 120 can be a polished bore receptacle. In some cases, the receptacle 120 is a smart receptacle which can be included as part of the downhole portion 124. The smart receptacle can stay permanently installed in the wellbore 102 and connect the uphole portion 122 which can be designed to be retrieved for repair or replacement, allowing to control of the valves at the downhole portion 124 and the production of reservoir fluids. Smart receptacles can include sensors and communication devices which remotely monitor and control downhole wellbore 102 conditions and reservoir fluid flow.

The jetting sub-assembly 104 directs multiple streams of a cleaning fluid at the inner surface 114 of the wellbore 102 to remove accumulations of junk and debris 112 from the inner surface 114. The cleaning fluid can be a completion fluid. For example, the completion fluid can be a brine, viscous brine, or clean mud. In some cases, cleaning chemicals or surfactants can be added to the completion fluids to increase the cleaning efficiency of the cleaning operation. For example, scale removal chemicals, organic deposits removal treatments, and viscous brines can be injected into the wellbore to improve wellbore cleaning.

The jetting sub-assembly 104 flows the cleaning fluid to impact the junk and debris 112. As shown in FIG. 1, the jetting sub-assembly 104 is disposed between the guide shoe sub-assembly 108 and the reverse circulation sub-assembly 106. Alternatively, the reverse circulation sub-assembly 106 can be positioned between the jetting sub-assembly and the guide shoe sub-assembly 108. For example, within the wellbore cleaning tool 100, the position of the jetting sub-assembly 104 and the reverse circulation sub-assembly 106 can be switched by the operator making up the sub-assemblies 104, 106 in a different order.

The jetting sub-assembly 104 has a hollow cylinder 126 defining a first inner void 128 and multiple jetting nozzles 130 fluidly coupled to the first inner void 128. The first inner void 128 receives the cleaning fluid from the reverse circulation sub-assembly 106 and conducts the cleaning fluid to the jetting nozzles 130. The jetting nozzles 130 direct the cleaning fluid from the first inner void 128 to a space 132 outside the first inner void 128. When the wellbore cleaning tool 100 is positioned in the wellbore 102, the space 132 is a wellbore annulus and the cleaning fluid impacts the inner surface 114. When the junk and debris 112 are on the inner surface 114 of the wellbore 102, the cleaning fluid can impact and remove of some or all of the junk and debris 112 from the inner surface 114.

The hollow cylinder 126 includes a first portion 138 and a second portion 140 coupled to the first portion 138. The first portion 138 has a first outer diameter 142. The second portion has a second outer diameter 144. The second portion 140 is downhole from the first portion 138. The second outer diameter 144 is less than the first outer diameter 142. That is, the first and second outer diameters 142, 144 define a go/no-go portion 185 of the wellbore cleaning tool 100 such that the guide shoe sub-assembly 108 and the second portion 140 if the jetting sub-assembly 104 is small enough to enter the receptacle 120 and the first portion 138 along with the reverse circulation sub-assembly 106 is too large to enter the receptacle 120.

In some implementations, all of the jetting nozzles 130 are positioned on the second portion 140. However, in some implementations, jetting nozzles 130 are positioned on the first portion 138, but below a jetting ball seat 146 (described below in more detail).

The jetting nozzles 130 increase a pressure and a velocity of the cleaning fluid of the cleaning fluid to hydraulically clean the inner surface 114 of the wellbore 102. In some implementations, one or more of the jetting nozzles 130 are angled in an uphole direction 134. For example, one or more of the jetting nozzles 130 can be oriented at an angle relative a perpendicular plane 136 in the uphole direction 134 to direct the cleaning fluid toward the inner surface 114 and the junk and debris 112 toward the reverse circulation sub-assembly 106. For example, one or more of the jetting nozzles 130 can be angled between zero degrees and approaching ninety degrees relative to the perpendicular plane 136. In some implementations, all of the jetting nozzles 130 can be oriented at the same angle. For example, all of the jetting nozzles 130 can be angled at forty-five degrees relative to the perpendicular plane 136. In other implementations, the jetting nozzles can be arranged in sequential layers, with each layer having an increasing or decreasing angle relative to the perpendicular plane 136.

The jetting nozzles 130 are positioned about the jetting sub-assembly 104 to direct the cleaning fluid in 360 degree coverage about second portion 140 the hollow cylinder 126. In some implementations, a portion of the cleaning fluid exiting the one jetting nozzle 130 can overlap with a portion of the cleaning fluid exiting another adjacent jetting nozzle 130. The jetting nozzles 130 are detachable and replaceable. The jetting nozzles 130 can screw or otherwise attach to the jetting sub-assembly 130. Some jetting nozzles 130 can be replaced with blanks. This allows the jetting nozzles 130 to be arranged the configuration preferred by the operator to maximize cleaning by screwing or attaching different jetting nozzles 130 of different sizes and plugging the holes as desired.

The jetting nozzles 130 have an outlet diameter. In some implementations, the diameter of all the jetting nozzles 130 is the same. Alternatively, the diameter of one or more jetting nozzles 130 can differ. The outlet diameter and geometry of the jetting nozzles 130 can be different so one or more of the jetting nozzles 130 deliver the cleaning fluid at a different flow rate or a different pressure than another jetting nozzle 130. In some implementations, the outlet diameter can be between 0.25 inches and 0.5 inches.

Figure 2:
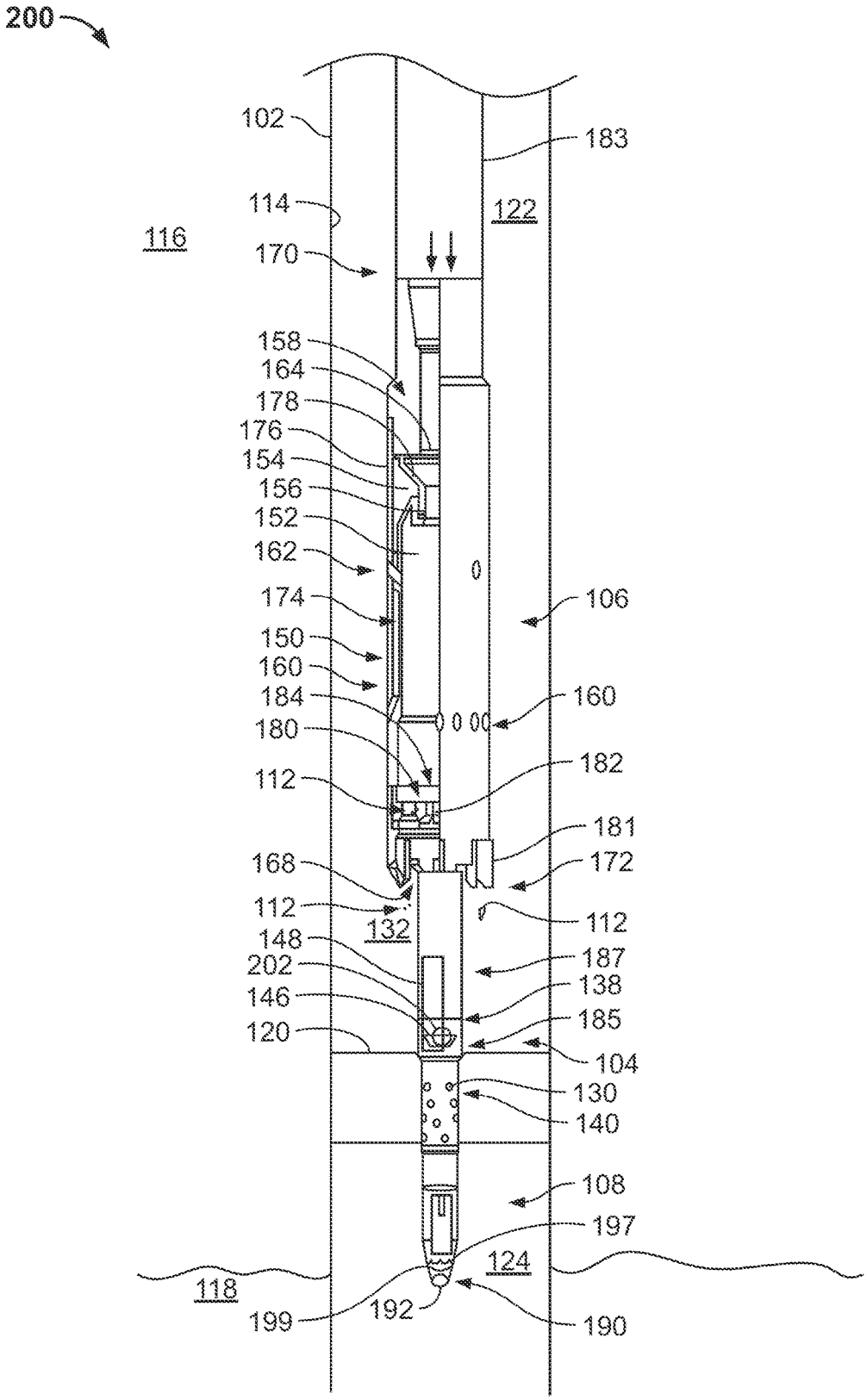
FIG. 2 is another schematic view of the wellbore cleaning tool of FIG. 1 in the wellbore with fluid flow stopped through the jetting sub-assembly.

The jetting sub-assembly 104 includes a jetting ball seat 146 positioned in the hollow cylinder 126 and sized to receive a jetting ball 202 (shown in FIG. 2). The jetting ball seat 146 allows the cleaning fluid to flow through the hollow cylinder 126 to the jetting nozzles 130 when no jetting ball is positioned on the jetting ball seat 146 (as shown in FIG. 1) as seen in cutout section 148 in FIG. 1.

The jetting sub-assembly 104 can be configured in two different positions. First, the wellbore cleaning tool 100 can be configured to be run in a jetting position and switched to reverse circulating. In the jetting position, the flow path will go below the jetting nozzles 130, which are below the respective setting ball (i.e., the jetting ball 202). When respective jetting ball 202 lands at the jetting ball seat 146 (here being the smaller ball), the jetting nozzles are deactivate (closing the flow path to the jetting nozzles) and the reverse circulation sub-assembly 106 is activated (diverting the flow path thru the second inner void 152.

First, the wellbore cleaning tool 100 can be configured to be run in a reverse circulating mode and switched to the jetting position. A bigger ball than the jetting ball 202 (the reverse circulation ball 302) will land at the reverse circulating ball seat 156, closing the reverse circulation path and by passing the flow to the jetting nozzles 130.

FIG. 2 is another schematic view of the wellbore cleaning tool 100 in the wellbore 102 with fluid flow stopped through the jetting sub-assembly 104. In FIG. 2, the wellbore cleaning tool 100 has been run downhole until the go/no-go portion 185 of the jetting sub-assembly 104 engages the receptacle 120. The operator can drop the jetting ball 202 into the wellbore cleaning tool 100 and the jetting ball seat 146 receives the jetting ball 202. Responsive to the jetting ball 202 landing on the jetting ball seat 146, flow of the cleaning fluid past the jetting ball seat 146, through the hollow cylinder 126, and out the jetting nozzles 130 is limited (e.g., stopped). The jetting ball 202 has an outer diameter. The outer diameter of the jetting ball 202 is sized to seal against the jetting ball seat 146. When the jetting sub-assembly 104 is positioned downstream from the reverse circulation sub-assembly 106, the outer diameter of the jetting ball 202 is sized to pass through the reverse circulation sub-assembly 106.

Figure 3:
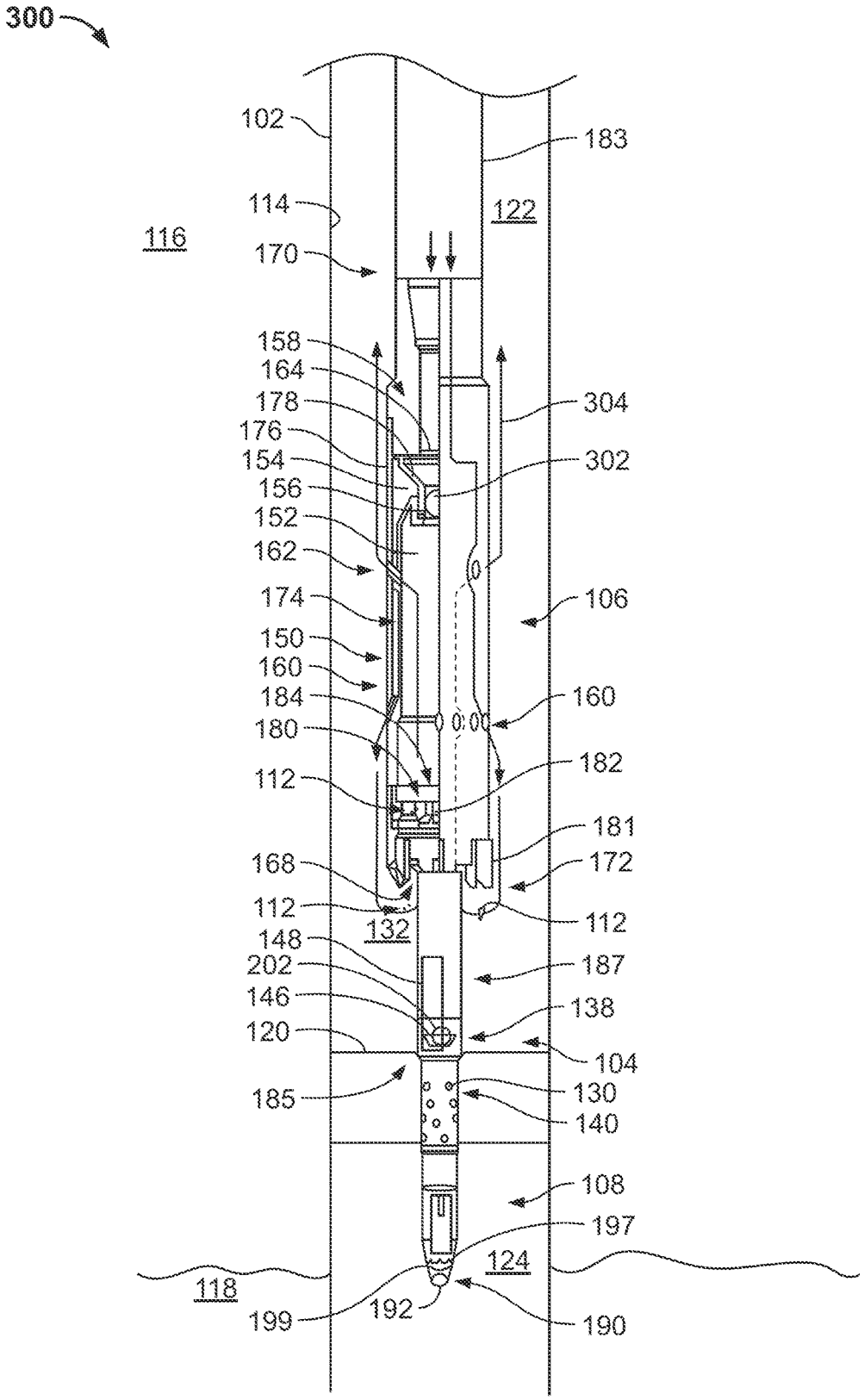
FIG. 3 is a schematic view of the wellbore cleaning tool of FIG. 1 cleaning the wellbore with a reverse circulation sub-assembly.

FIG. 3 is a schematic view of the wellbore cleaning tool 100 of FIG. 1 cleaning the wellbore 102 with the reverse circulation sub-assembly 106. Referring to FIGS. 1-3, the reverse circulation sub-assembly 106 can be operated to change between two flow path modes, a first mode providing a flow path for the cleaning fluid to flow through the jetting sub-assembly 104 with no reverse circulation and a second mode providing a flow path for the cleaning fluid to flow through the jetting sub-assembly by reverse circulating the cleaning fluid and wellbore fluid, with no cleaning fluid provided to the jetting sub-assembly 104.

The reverse circulation sub-assembly 106 has a barrel 150 defining a second inner void 152 and a third inner void 154. The second inner void 152 and the third inner void 154 are fluidly decouplable to control the flow of cleaning fluid through the reverse circulation sub-assembly 106, that is, between the first mode and the second mode to provide cleaning fluid to the jetting sub-assembly 104 or reverse circulation flow with the reverse circulation sub-assembly 106. The reverse circulation sub-assembly 106 has a first end 170 (i.e., an uphole end) and a second end 172 (i.e., a downhole end). The reverse circulation sub-assembly 106 includes a ball seat 156 (i.e., a reverse circulation ball seat) positioned in the barrel 150 between the second inner void 152 and the third inner void 154 and sized to receive a reverse circulation ball 302 (shown in FIG. 3). The ball seat 156 allows the cleaning fluid to flow through the second inner void 152 of the barrel 150 to the jetting sub-assembly 104 when no reverse circulation ball 302 is positioned on the ball seat 156 (as shown in FIG. 1) as seen in cutout section 158 in FIG. 1. Referring to FIG. 3, the operator has dropped the reverse circulation ball 302 into the wellbore cleaning tool 100 and the ball seat 156 has received the reverse circulation ball 302. Responsive to the reverse circulation ball 302 landing on the ball seat 156, flow of the cleaning fluid past the ball seat 156 to the jetting sub-assembly 104 is limited (i.e., stopped) and a reverse circulation flow path 304 is initiated. Initiating the reverse circulation flow path 304 can remove the junk and debris 112 from the wellbore 102 as described in more detail below.

The reverse circulation ball 302 has an outer diameter. The outer diameter of the reverse circulation ball 302 is sized to seal against the ball seat 156. When the jetting sub-assembly 104 is positioned downstream from the reverse circulation sub-assembly 106, ball seat 156 is sized to pass the jetting ball 202 to the jetting sub-assembly 104 but receive and hold the reverse circulation ball 302. That is, the outer diameter of the reverse circulation ball 302 is greater than the outer diameter of the jetting ball 202 which is sized to pass through the reverse circulation sub-assembly 106.

The reverse circulation sub-assembly 104 includes a valve cup 178 coupled to the ball seat 156. The valve cup 178 directs the reverse circulation ball 302 to the ball seat 156. The valve cup 178 provides the bypass path to the jetting sub-assembly 104 when the reverse circulation ball 302 (described in more detail below, the arrival of a bigger ball than the jetting ball 202.)

The barrel 150 defines a first set of outlet ports 160 extending from the third inner void 154 to the space 132 outside the wellbore cleaning tool 100 to fluidly couple the third inner void 154 to the space 132 outside the wellbore cleaning tool 100. The first set of outlet ports 160 are angled toward the second end 172 (i.e., in a downhole direction) to direct cleaning fluid flow toward the second end 172 outside the barrel 150. In some implementations, the outlet ports 160 have a diameter of between 0.25 and 0.5 inches. In some implementations, there are between eight and sixteen outlet ports 160.

The barrel 150 defines a second set of outlet ports 162 extending from the second inner void 152 to the space 132 outside the wellbore cleaning tool 100 to fluidly couple the second inner void 152 to the space 132 outside the wellbore cleaning tool 100. The first set of outlet ports 160 is positioned closer to the second end 172 and the second set of outlet ports 162 is positioned closer to the first end 170. The second set of outlet ports 162 are angled toward the first end 170 (i.e., in an uphole direction) to direct cleaning fluid flow toward the first end 170 outside the barrel 150. In some implementations, the outlet ports 162 have a diameter of between 0.125 and 0.5 inches. In some implementations, there are between eight and sixteen outlet ports 162.

The barrel 150 has a first fluid port 164 to receive the cleaning fluid. The first fluid port 164 directs the cleaning fluid to either the second inner void 152 or the third inner void 154, depending on the presence of the reverse circulation ball 302 at the ball seat 156.

The barrel 150 has a second fluid port 166 to receive the cleaning fluid from the second inner void 152 and direct the cleaning fluid to the jetting sub-assembly 104. The second fluid port 166 is open when the reverse circulation sub-assembly 106 is in the first mode (i.e., providing the cleaning fluid to the jetting sub-assembly 104) and shut when the reverse circulation sub-assembly 106 is in the second mode (i.e., reverse circulating). The second fluid port 166 is positioned at the second end 172 of the reverse circulation sub-assembly 106.

The barrel 150 has a third fluid port 168 to receive the wellbore fluid containing junk and debris 112 into the second inner void 152 during reverse circulation operations (i.e., in the second mode). When the reverse circulation sub-assembly 106 is in the first mode, the third fluid port 168 is shut, allowing the cleaning fluid to enter the second fluid port 166 and flow into the jetting sub-assembly 104. When the reverse circulation sub-assembly 106 is in the second mode, the third fluid port 168 is open, allowing the wellbore fluids to enter the third fluid port 168 and flow into the second inner void 152. The third fluid port 168 is positioned at the second end 172 of the reverse circulation sub-assembly 106.

The reverse circulation ball 302 contacts the ball seat 156 and seals the ball seat 156 from cleaning fluid flow. When the reverse circulation ball 302 seals against the ball seat 156, pressure in the barrel 150 increases above a threshold pressure. When the pressure increases above the threshold pressure, three operations occur: i) the first and second sets of outlet ports 160, 162 open, ii) the third fluid port 168 opens, and iii) the second fluid port 166 shut. This places the reverse circulation sub-assembly 106 in the second mode providing the reverse circulation flow path 304 for the cleaning fluid and wellbore fluid.

Referring to FIG. 1, when the wellbore cleaning tool 100 is in the first mode (i.e., cleaning with the jetting sub-assembly 104), the operator has not yet placed the reverse circulation ball 302 and the jetting ball 202 in the wellbore cleaning tool 100 at the respective ball seats 156, 146. The second inner void 152 of the reverse circulation sub-assembly 106 is fluidly coupled to the first inner void 128 of the jetting sub-assembly 104 defining a jetting flow path (a first flow path). The cleaning fluid is free to flow through the second inner void 152 from the first fluid port 164 to the second fluid port 166 and into the jetting sub-assembly 104 to the first inner void 128 and out the jetting nozzles 130. The operator can drop the jetting ball 202 to stop the cleaning fluid flowing in the first mode (shown in FIG. 2). In some cases, the wellbore cleaning tool 100 can inspect the inner surface 114 of the wellbore 102 when the cleaning fluid is stopped from flowing through the jetting nozzles 130.

Referring to FIG. 3, when the wellbore cleaning tool 100 is in the second mode (i.e., reverse circulation), the reverse circulation ball 302 is positioned on the ball seat 156. Flow of cleaning fluid through the second inner void 152 is prevented. The cleaning fluid flows through the third inner void 154, down an inner annulus 174 of the reverse circulation sub-assembly 104 between the second inner void 152 and the barrel 150, and out the first set of outlet ports 160 into the space 132 outside the wellbore cleaning tool 100. The cleaning fluid mixes with wellbore fluid and picks up junk and debris 112 and moves the junk and debris 112 toward the second end 172 to the third fluid port 168 along an outer surface 176 of the barrel 150. The junk and debris 112, wellbore fluid, and cleaning fluid flow into the third fluid port 168 and a portion of the junk and debris 112 is removed from the mixed wellbore fluid and cleaning fluid (described below in more detail). The cleaned wellbore fluid/cleaning fluid mixture flows through the second inner void from the second end 172 toward the first end 170. The cleaned wellbore fluid/cleaning fluid mixture then flows out of the second inner void 152 through the second set of outlet ports 162 back into the wellbore 102. The cleaned wellbore fluid/cleaning fluid mixture is directed toward the first end 170 the barrel 150.

The reverse circulation sub-assembly 106 includes a junk catcher 180 to remove the junk and debris 112 from the wellbore fluid/cleaning fluid mixture flowing through the second inner void 152 when reverse circulating. The junk catcher 180 includes retractile fingers 182 to capture the junk and debris 112. The retractile fingers 182 are retracted and in line with the barrel 150 when the reverse circulation sub-assembly 106 is in the first mode (i.e., cleaning by jetting). When the pressure increases in the second inner void 152 because the reverse circulation ball 302 has sealed the ball seat 156, the retractile fingers 182 extend into a center portion 184 of the second inner void 152 and are positioned to capture the junk and debris 112 flowing through the second inner void 152. In some cases, the retractile fingers 182 are magnetic. In some cases, the junk catcher 180 can include a junk basket. The retractile fingers 182 can move upward to allow the debris 112 go into the inner void 182. Downward movement of the retractile fingers 182 is limited to a closed position trapping or keeping the debris 112 inside the inner void 152.

The reverse circulation sub-assembly 106 includes a mill 181. Sometimes the junk and debris 112 accumulate on the inner surface 114 to a height from the inner surface 114 such that the mill 181 can be used to remove a portion of the junk and debris 112. The mill 181 can be used concurrently with the jetting nozzles 130 to alternately or simultaneously physically (i.e., by the mill 181) and hydraulically (i.e., by the jetting nozzles 130 and the cleaning fluid) remove the junk and debris 112 from the inner surface 114 of the wellbore 102. The mill 181 can remove debris 112 from the inner surface 114 of the wellbore 102 while the wellbore cleaning tool 100 is run in hole and debris 112 are encountered in the path of travel. The mill 181 can remove and break the debris 112 into smaller pieces of debris 112, making the debris easier to be circulated out or caught in the retractile fingers 182.

The reverse circulation sub-assembly 106 includes a connector 186 positioned at the first end 170 of the barrel 150. The connector 186 couples to a downhole conveyance 183 to position in the wellbore cleaning tool 100 in the wellbore 102. The downhole conveyance 183 can be a coiled tubing assembly or a wireline assembly. In this implementation, the connector 186 is a box and pin connector. However, in other implementations, the connector 186 can be any type of rotary shouldered connection. For example, the connector 186 can be a standard API (American Petroleum Institute) pin connection such as a regular connection, a numeric connection, an internal flush connection, or a full hole connection. In some implementations, the connector 186 can be a manufacturer proprietary design. In some implementations, the connector 186 can be a box connection, where the threads are internal to the box. The connector 186 can have an outer diameter corresponding to a standard American Petroleum Institute connection size. For example, the connector 186 can have an outer diameter of 2⅜ inches, 2⅞ inches, 3½ inches, 4½ inches, 5½ inches, 6⅝ inches, 7⅝ inches, or 8⅝ inches.

The guide shoe sub-assembly 108 guides the wellbore cleaning tool 100 into the receptacle 120. The guide shoe sub-assembly 108 protects and operates the camera 110 to inspect the inner surface 114 of the wellbore 102 before, during, and after jetting and recirculating with the jetting sub-assembly 104 and the reverse circulation sub-assembly 106, respectively. The guide shoe sub-assembly 108 has a first end 188 and a second end 190. The first end 188 is coupled to the jetting sub-assembly 104. The second end 190 is a downhole end of the wellbore cleaning tool 100.

The guide shoe sub-assembly 108 has a guide shoe 192. The guide shoe 192 is a rounded shape to direct the wellbore cleaning tool 100 into the receptacle 120. The guide shoe 192 has internal insulation material to protect the camera 110 and other electronics. The guide shoe 192 has a retrievable cap 198 to allow retrieval of the camera 110 when the guide shoe sub-assembly 108 is at the surface of the Earth. The guide shoe sub-assembly 108 is a polished material and the second end 190 has a soft, rounded shape to avoid scratching or damaging the receptacle 120, especially when the receptacle is the smart receptacle. The guide shoe sub-assembly 108 has a premium threaded connection to connect it to the bottom of jetting sub-assembly 104 with a metal to metal type of seal.

The guide shoe sub-assembly 108 has a body 194 defining a protective void 196 sized to receive and protect the camera 110. The body 194 thermally and hydraulically protects the camera 110. The protective void 196 can have a diameter of the between 1.5-2.5 inches. The protective void 196 can have a length of between 1 foot and 3 feet. In some implementations, the guide shoe sub-assembly 108 protects the camera 110 up to a high temperature limit of 350° F. and high pressure limit of 10,000 psi.

The body 194 can include conductive and temperature insulation material. For example, the body 194 can include one or more of a silicon, a mineral oil, or a thermic cover.

The body 194 can hold the camera 110 in the protective void 196 so that the camera 110 is centered in the guide shoe sub-assembly 108. Centering the camera 110 can reduce shock or vibration to the camera 110. The camera 110 can be protected by the insulation material. The insulation material is arranged concentrically away from shoe inner diameter and holds the camera 110 at the top and bottom soft seals elements (such as the o-rings described below) sealing the protective void 196 so that all guide shoe sub-assembly is designed to reduce shock impacts transferred into the camera 110.

The protective void 196 is sealed toward the first end 188 by a cap 198. The cap 198 is threadedly into the body 194 of the guide shoe sub-assembly 108 so the cap can be removed by the operator when the wellbore cleaning tool 100 is at the surface of the Earth, for example, to place into or remove the camera 110 from the protective void 196. The cap 198 can be metal. The guide shoe sub-assembly 108 can include an o-ring positioned between the cap 198 and the body 194 to further seal the protective void 196 and protect the camera 110.

The guide shoe sub-assembly 108 has a glass 199 further defining the protective void 196. The glass 199 allows the camera 110 to inspect the inner surface 114 of the wellbore 102 and remain protected from wellbore 102 conditions while positioned in the protective void 196. The glass is positioned at the second end 190 of the guide shoe sub-assembly 108. The glass 199 can be a high-pressure/high temperature glass. In some implementations, the glass 199 has a thickness of at least one inch.

The guide shoe sub-assembly 108 has a light source 197 coupled at the second end 190. The light source 197 is controllable to illuminate the inner surface 114 of the wellbore 102 to improve the quality of images collected by the camera 110. The light source 197 can be multiple light emitting diodes (LEDs). The LEDs can be positioned about the glass 199 in a circular arrangement to illuminate the inner surface 114 of the wellbore 102. The camera 110 is oriented to inspect the cleanliness of the inner surface 114 of the wellbore 102 by capturing images of any junk and debris 112 accumulated on the inner surface 114 illuminated by the light source 197.

The guide shoe sub-assembly 108 has a battery 195 to power the light source 197, the camera 110, and a controller 193 (described in more detail below). For example, the battery 195 can be a replaceable battery (single use) or a rechargeable battery. The battery 195 can be replaced at the surface of the Earth.

The camera 110 has a memory storage to store the images of the inner surface 114. The controller 193 operates the camera 110 and the light source 197. The controller 193 has a timer 191. The controller 193 initiates the timer 191 to count down to a pre-determined time, provide power to the light source 197 and the camera 110, and instructing the camera 110 to take pictures of the inner surface 114 of the wellbore 102. The pre-determined time is selected by the operator based on planned jetting nozzle 130 cleaning and reverse circulation durations, cycle count, and wellbore length to clean the wellbore 102.

The wellbore cleaning tool 100 can include an extension tube 187 coupled between the reverse circulation sub-assembly 106 to the jetting sub-assembly 104. The extension tube 187 conducts the cleaning fluid from the reverse circulation sub-assembly 106 to the jetting sub-assembly 104 when the jetting sub-assembly 104 is cleaning the inner surface 114. The extension tube 187 can be added to the jetting sub-assembly 104 between the first and second portions 138, 140 to extend the jetting nozzles 130 below the receptacle 120 if cleaning by jetting below the receptacle is needed, or between the jetting assembly 104 and the guide shoe sub-assembly 108 if inspection farther below the receptacle 120 is desired. Selection on the size and length of the extension tube 110 can be based on adjusting the wellbore cleaning tool 100 to fit reaching the required depth and matching the jetting sub-assembly 104 diameter.

Figure 4:
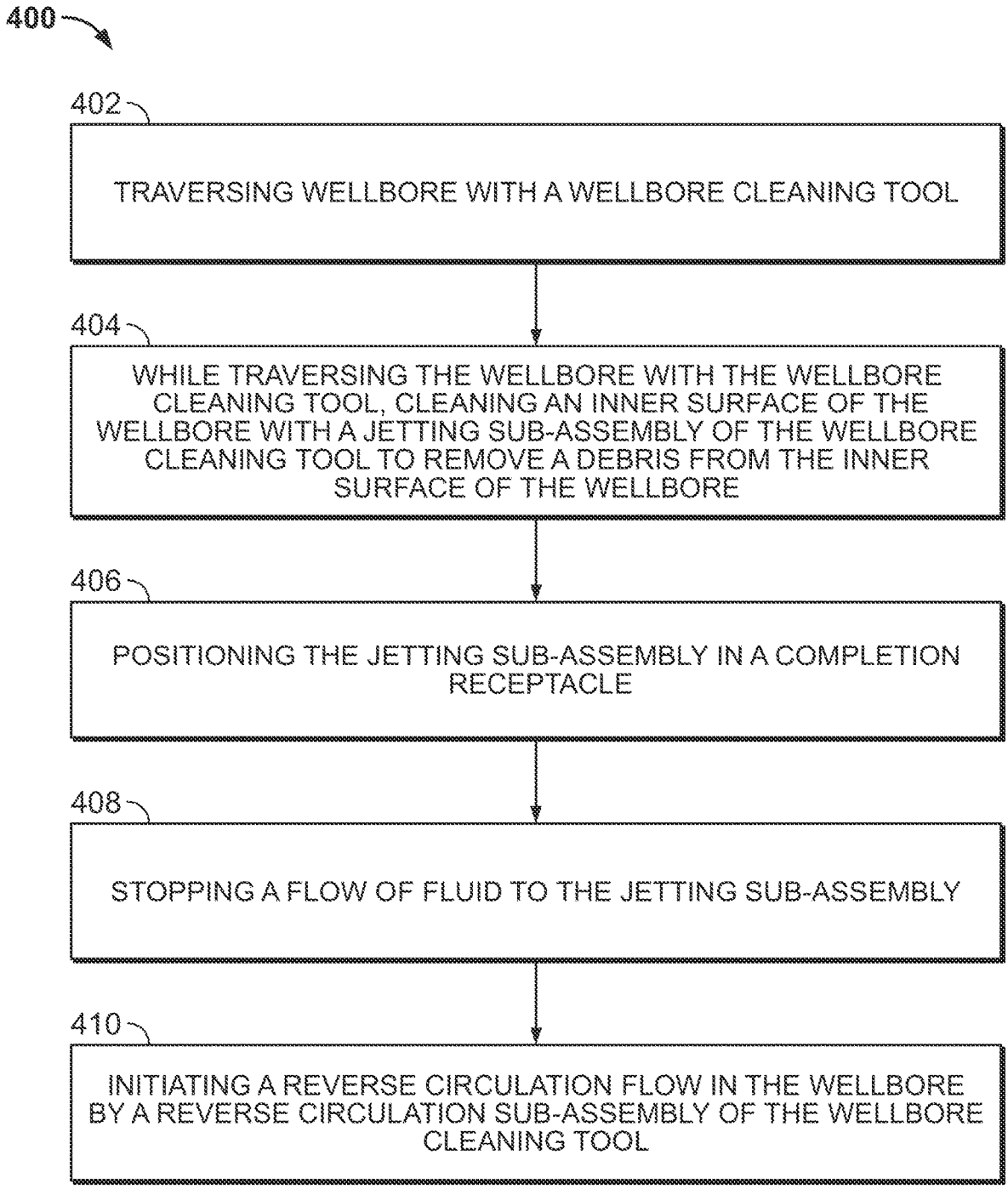
FIG. 4 is a flow chart of an example method of cleaning and inspecting a wellbore according to the implementations of the present disclosure.

FIG. 4 is a flow chart of an example method of cleaning and inspecting the wellbore according to the implementations of the present disclosure. The method 400 is described with reference to the wellbore cleaning tool 100 shown in FIGS. 1-3, but can be implemented with other wellbore cleaning tools. At 402, a wellbore cleaning tool traverses a wellbore. For example, the wellbore cleaning tool 100 passes through the wellbore 102.

At 404, while traversing the wellbore with the wellbore cleaning tool, an inner surface of the wellbore is cleaned with a jetting sub-assembly of the wellbore cleaning tool to remove a debris from the inner surface of the wellbore. For example, the jetting sub-assembly 104 can direct cleaning fluid through the jetting nozzles 130 at the inner surface 114, removing junk and debris 112 from the inner surface 114.

At 406, the jetting sub-assembly is positioned in a completion receptacle. For example, the jetting sub-assembly 104, guided by the guide shoe sub-assembly 108, can pass into the receptacle 120 until the first portion 138 of the jetting sub-assembly 108 is within the receptacle 120 and the go/no-go feature 185 contacts the receptacle 120.

At 408, a flow of fluid though the jetting sub-assembly is stopped. For example, the operator can drop the jetting ball 202 into the wellbore cleaning tool 100 until the jetting ball 202 seals against the jetting ball seat 146, stopping the cleaning fluid from flowing to the jetting sub-assembly 104.

At 410, reverse circulation flow is initiated in the wellbore by a reverse circulation sub-assembly of the wellbore cleaning tool. For example, the operator can drop the reverse circulation ball 302 into the wellbore cleaning tool and the reverse circulation ball 302 can drop to contact the ball seat 156, stopping flow through the second inner void 152. The cleaning fluid is redirected through the third inner void 154, down an inner annulus 174 of the reverse circulation sub-assembly 104 between the second inner void 152 and the barrel 150, and out the first set of outlet ports 160 into the space 132 outside the wellbore cleaning tool 100. The cleaning fluid then mixes with wellbore fluid and picks up junk and debris 112 and moves the junk and debris 112 toward the second end 172 to the third fluid port 168 along an outer surface 176 of the barrel 150. The junk and debris 112, wellbore fluid, and cleaning fluid flow into the third fluid port 168 and a portion of the junk and debris 112 is removed from the mixed wellbore fluid and cleaning fluid by the retractile fingers 182 of the junk catcher 180. The cleaned wellbore fluid/cleaning fluid mixture flows through the second inner void from the second end 172 toward the first end 170. The cleaned wellbore fluid/cleaning fluid mixture then flows out of the second inner void 152 through the second set of outlet ports 162 back into the wellbore 102. The cleaned wellbore fluid/cleaning fluid mixture is directed toward the first end 170 the barrel 150.

In some implementations, the method includes inspecting the inner surface of the wellbore with a camera of the wellbore cleaning tool. For example, after the controller 193 can count down the time using the timer 191 to the pre-determine time. Once the pre-determined time is reached, the controller 193 can flow electricity from battery 195 to the light source 197, illuminating the inner surface 114 of the wellbore. The controller 193 can command the camera 110 to capture an image of the inner surface 114 of the wellbore 102.

EMBODIMENTS

In an example aspect, a wellbore cleaning tool for cleaning and inspecting a wellbore includes a jetting sub-assembly, a reverse circulation sub-assembly, and a guide shoe sub-assembly. The jetting sub-assembly includes a hollow cylinder and jetting nozzles. The hollow cylinder defines a first inner void. The jetting nozzles are fluidly coupled to the first inner void. The jetting nozzles are oriented to direct a fluid from the first inner void to a space outside the wellbore cleaning tool. The reverse circulation sub-assembly is coupled to the jetting sub-assembly. The reverse circulation sub-assembly includes a barrel with a first fluid port, a first set of outlet ports, a second set of outlet ports, a second fluid port; and a third fluid port. The barrel defines a second inner void and a third inner void fluidly decouplable from the second inner void. The barrel has a first end defining the first fluid port and a second end opposite the first end. The second inner void and the third inner void are fluidly couplable to the first inner void of the reverse circulation sub-assembly. The first set of outlet ports extend through the barrel from the second inner void to the space outside the wellbore cleaning tool. The second set of outlet ports extend through the barrel from the third inner void to the space outside the wellbore cleaning tool. The second fluid port controls fluid flow between space outside the wellbore cleaning tool and the second inner void. The third fluid port controls fluid flow through the second inner void fluidly to the jetting sub-assembly. The guide shoe sub-assembly includes a camera. The guide shoe sub-assembly is positioned at a downhole end of the wellbore cleaning tool.

In an example aspect combinable with any other example aspect, the jetting sub-assembly is positioned closer to the downhole end of the wellbore cleaning tool than the reverse circulation sub-assembly.

In an example aspect combinable with any other example aspect, when the second inner void is fluidly decoupled from the third inner void, the reverse circulation sub-assembly defines a first fluid flow path. Fluid flowing into the first end of the barrel flows through the second inner void to the first set of outlet ports into the space outside the barrel, along an outer surface of the barrel to the inlet port, through the inlet port into the second inner void, through the second inner void to the second set of outlet ports, and out the second set of outlet ports to the space outside the barrel.

In an example aspect combinable with any other example aspect, when the second inner void is fluidly coupled to the third inner void, the reverse circulation sub-assembly defines a second fluid flow path. Fluid flowing into the first end of the barrel flows through the second inner void to the third inner void and out the flow port.

In an example aspect combinable with any other example aspect, the inlet port is positioned at the second end of the reverse circulation sub-assembly.

In an example aspect combinable with any other example aspect, the first set of outlet ports is positioned closer to the second end and the second set of outlet ports is positioned closer to the first end.

In an example aspect combinable with any other example aspect, the reverse circulation sub-assembly includes a reverse circulation valve seat to receive a reverse circulation ball. The reverse circulation valve seat is positioned between the second inner void and the third inner void.

In an example aspect combinable with any other example aspect, the reverse circulation sub-assembly further includes a valve cup coupled to the reverse circulation valve seat.

In an example aspect combinable with any other example aspect, the jetting nozzles are oriented relative to the jetting sub-assembly to direct the fluid from the jetting nozzles toward the reverse circulation sub-assembly.

In an example aspect combinable with any other example aspect, the jetting nozzles include at least one jetting nozzle having a different outlet diameter than another jetting nozzle.

In an example aspect combinable with any other example aspect, the hollow cylinder includes a first portion defining a first outer diameter and a second portion coupled to the first portion. The jetting nozzles are positioned on the second portion. The second portion defines a second outer diameter. The second outer diameter is less than the first outer diameter.

In an example aspect combinable with any other example aspect, the jetting sub-assembly includes a jetting ball seat to receive a jetting ball. The jetting ball seat is positioned in the first portion of the hollow cylinder. The jetting ball being placed on the jetting ball seat stops fluid flow through the jetting sub-assembly to the jetting nozzles.

In an example aspect combinable with any other example aspect, the guide shoe sub-assembly further includes a light source coupled at the downhole end of wellbore cleaning tool.

In an example aspect combinable with any other example aspect, the guide shoe sub-assembly includes a controller with a timer. The controller performs operations including initiating the timer to count a time; counting, by the timer, until the time is equal to a pre-determined time; and based on the time equal to the pre-determined time, suppling electrical power from a battery to the light source and the camera.

In an example aspect combinable with any other example aspect, the controller also performs operations including based on the time equal to the pre-determined time, taking a picture of the wellbore with the camera and storing the picture.

In another example aspect, a wellbore is cleaned and inspected. Cleaning and inspecting the wellbore includes traversing wellbore with a wellbore cleaning tool; while traversing the wellbore with the wellbore cleaning tool, cleaning an inner surface of the wellbore with a jetting sub-assembly of the wellbore cleaning tool to remove a debris from the inner surface of the wellbore; positioning the jetting sub-assembly in a completion receptacle; stopping a flow of fluid to the jetting sub-assembly; and initiating a reverse circulation flow in the wellbore by a reverse circulation sub-assembly of the wellbore cleaning tool.

In an example aspect combinable with any other example aspect, responsive to initiating the reverse circulation flow in the wellbore by the reverse circulation sub-assembly of the wellbore cleaning tool, capturing the debris in the reverse circulation sub-assembly.

In an example aspect combinable with any other example aspect, stopping the flow of fluid to the jetting sub-assembly includes conducting a jetting ball through the wellbore cleaning tool to a jetting ball seat; receiving the jetting ball at the jetting ball seat; and responsive to receiving the jetting ball at the jetting ball seat, stopping the flow of fluid to the jetting sub-assembly.

In an example aspect combinable with any other example aspect, initiating the reverse circulation flow in the wellbore by the reverse circulation sub-assembly of the wellbore cleaning tool includes conducting a reverse circulation ball through the wellbore cleaning tool to reverse circulation ball seat; receiving the reverse circulation ball at the reverse circulation ball seat; and responsive to receiving the reverse circulation ball at the reverse circulation ball seat, flowing a fluid from inside the wellbore cleaning tool out of the reverse circulation sub-assembly by a first set of outlet ports, through a wellbore annulus defined by the inner surface of the wellbore and an outer surface of the wellbore cleaning tool in a downhole direction, into an inlet port of the reverse circulation sub-assembly, past a junk catcher of the reverse circulation sub-assembly, out a second set of outlet ports, and through the wellbore annulus in an uphole direction.

In an example aspect combinable with any other example aspect, further including inspecting the inner surface of the wellbore with a camera of the wellbore cleaning tool.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellbore cleaning tool for cleaning and inspecting a wellbore, the wellbore cleaning tool comprising:

a jetting sub-assembly comprising:

a hollow cylinder defining a first inner void; and a plurality of jetting nozzles fluidly coupled to the first inner void, the plurality of jetting nozzles oriented to direct a fluid from the first inner void to a space outside the wellbore cleaning tool;

a reverse circulation sub-assembly coupled to the jetting sub-assembly, the reverse circulation sub-assembly comprising:

a barrel defining a second inner void and a third inner void fluidly decouplable from the second inner void, the barrel comprising a first end defining a first fluid port and a second end opposite the first end, the second inner void and the third inner void fluidly couplable to the first inner void of the reverse circulation sub-assembly;

a first plurality of outlet ports extending through the barrel from the second inner void to the space outside the wellbore cleaning tool;

a second plurality of outlet ports extending through the barrel from the third inner void to the space outside the wellbore cleaning tool;

a second fluid port configured to control fluid flow between the space outside the wellbore cleaning tool and the second inner void; and a third fluid port configured to control fluid flow through the second inner void fluidly to the jetting sub-assembly; and a guide shoe sub-assembly comprising a camera, the guide shoe sub-assembly positioned at a downhole end of the wellbore cleaning tool.

2. The wellbore cleaning tool of claim 1, wherein the jetting sub-assembly is positioned closer to the downhole end of the wellbore cleaning tool than the reverse circulation sub-assembly.

3. The wellbore cleaning tool of claim 1, wherein when the second inner void is fluidly decoupled from the third inner void, the reverse circulation sub-assembly defines a first fluid flow path, wherein fluid flowing into the first end of the barrel flows through the second inner void to the first plurality of outlet ports into the space outside the barrel, along an outer surface of the barrel to the first fluid port, through the first fluid port into the second inner void, through the second inner void to the second plurality of outlet ports, and out the second plurality of outlet ports to the space outside the barrel.

4. The wellbore cleaning tool of claim 3, wherein when the second inner void is fluidly coupled to the third inner void, the reverse circulation sub-assembly defines a second fluid flow path, wherein fluid flowing into the first end of the barrel flows through the second inner void to the third inner void and out the first plurality of outlet ports.

5. The wellbore cleaning tool of claim 4, wherein the first fluid port is positioned at the second end of the reverse circulation sub-assembly.

6. The wellbore cleaning tool of claim 1, wherein the first plurality of outlet ports is positioned closer to the second end and the second plurality of outlet ports is positioned closer to the first end.

7. The wellbore cleaning tool of claim 1, wherein the reverse circulation sub-assembly comprises a reverse circulation valve seat configured to receive a reverse circulation ball, the reverse circulation valve seat positioned between the second inner void and the third inner void.

8. The wellbore cleaning tool of claim 7, wherein the reverse circulation sub-assembly further comprises a valve cup coupled to the reverse circulation valve seat.

9. The wellbore cleaning tool of claim 1, wherein the plurality of jetting nozzles are oriented relative to the jetting sub-assembly to direct the fluid from the plurality of jetting nozzles toward the reverse circulation sub-assembly.

10. The wellbore cleaning tool of claim 1, wherein the plurality of jetting nozzles comprises at least one jetting nozzle having a different outlet diameter than another jetting nozzle.

11. The wellbore cleaning tool of claim 1, wherein the hollow cylinder comprises a first portion defining a first outer diameter and a second portion coupled to the first portion, the plurality of jetting nozzles positioned on the second portion, the second portion defining a second outer diameter, the second outer diameter less than the first outer diameter.

12. The wellbore cleaning tool of claim 11, wherein the jetting sub-assembly comprises a jetting ball seat configured to receive a jetting ball, the jetting ball seat positioned in the first portion of the hollow cylinder, wherein the jetting ball placed on the jetting ball seat stops fluid flow through the jetting sub-assembly to the plurality of jetting nozzles.

13. The wellbore cleaning tool of claim 1, wherein the guide shoe sub-assembly further comprises a light source coupled at the downhole end of the wellbore cleaning tool.

14. The wellbore cleaning tool of claim 13, wherein the guide shoe sub-assembly comprises a controller comprising timer, the controller configured to perform operations comprising:

initiating the timer to count a time;

counting, by the timer, until the time is equal to a pre-determined time; and based on the time equal to the pre-determined time, suppling electrical power from a battery to the light source and the camera.

15. The wellbore cleaning tool of claim 14, wherein the controller is further configured to perform operations comprising:

based on the time equal to the pre-determined time, taking a picture, by the camera, of the wellbore; and storing the picture.

* * * * *